United States Patent [19]

Jaeger

[11] 4,371,274

[45] Feb. 1, 1983

[54] APPARATUS FOR DOT-MATRIX PRINTING WITH PROPORTIONAL CHARACTER SPACING

[75] Inventor: Klaus Jaeger, Puchheim, Fed. Rep. of Germany

[73] Assignee: Siemens Aktiengesellschaft, Berlin and Munich, Fed. Rep. of Germany

[21] Appl. No.: 191,401

[22] Filed: Sep. 29, 1980

[30] Foreign Application Priority Data

Oct. 17, 1979 [DE] Fed. Rep. of Germany ..... 2942058

[51] Int. Cl.[3] ..... B41J 3/12; B41J 19/58

[52] U.S. Cl. ..... 400/121; 400/124; 400/303; 400/306

[58] Field of Search ..... 400/121, 124, 303, 305, 400/306; 364/900 MS File; 101/93.04, 93.05

[56] References Cited

U.S. PATENT DOCUMENTS 3,754,229 8/1973 Manber ..... 340/750 X

FOREIGN PATENT DOCUMENTS 27590 4/1981 European Pat. Off. ..... 400/121
7732410 5/1978 France .
7736004 6/1978 France .

OTHER PUBLICATIONS

*IBM Tech. Disc. Bulletin,* T. Nohzawa, vol. 22, No. 8B, Jan., 1980, pp. 3742–3743.
*IBM Tech. Disc. Bulletin,* M. Dyche, vol. 21, No. 4, Sep., 1978, pp. 1676–1677.
IBM Technical Disclosure Bulletin, Simpson et al., vol. 12, No. 12, May 1970, pp. 2258–2259.

*Primary Examiner*—Paul T. Sewell

[57] ABSTRACT

An apparatus for dot-matrix printing with proportional character spacing utilizes a conventional character generator for generating characters with fixed spacing in which a matrix storage area of equal size is assigned to each character, regardless of the actual width of the character, and has an advance control for a printer carriage drive for advancing the drive in increments corresponding to each single column of the storage area, the apparatus having a control unit operable in a state for generating proportional character spacing as well as in a state for generating characters with fixed spacing, and a printing control unit for operation in a state for generating proportional character spacing which executes advance increments for occupied columns in the storage areas and assigns a space advance of a predetermined width to the total of the number of empty columns between two adjacent characters in the storage areas.

4 Claims, 3 Drawing Figures

INPUT DEVICE
T
CHARACTER CONTROL UNIT
CHARACTER GENERATOR
ZG
VS
AMPLIFIER STAGE
PRINTER CARRIAGE DRIVE
SW
SZ
COLUMN COUNTER
≧1
OG
ADVANCE CONTROL
&
VA
UG
STORAGE ELEMENT
SG
FPU
AE
PRINTING CONTROL UNIT

APPARATUS FOR DOT-MATRIX PRINTING WITH PROPORTIONAL CHARACTER SPACING

BACKGROUND OF THE INVENTION

1. Field of the Invention

The present invention relates to dot-matrix printing mechanisms for printing characters using a character generator in which the printable characters are stored in binary form in rows and columns of character elements and having a control unit for controlling the advance of a print head post-connected to the character generator.

2. Description of the Prior Art

Characters may be printed by dot-matrix (mosaic) printing devices either with a fixed spacing between adjacent characters or with a proportional spacing between adjacent characters which is adjusted according to the width of the character to be printed. Material printed utilizing fixed spacing between the characters has a substantially poorer overall general impression of the print image than does material printed with proportional spacing. A character generator is known from U.S. Pat. No. 4,071,130, corresponding to German OS No. 26 03 347 for use with dot-matrix printing devices which have fixed character spacing. The characters are stored in matrix-like storage areas of equal size. When a character is called, these storage areas are scanned column by column, each column in a storage area being assigned a single advance increment for the print head of the device. Because each character does not occupy the entire storage area, varying amounts of blank columns will be present on either side of a character centered in the storage area, so that when the entire storage area is utilized for printing adjacent characters, the spacing between the printed characters will not be uniform.

For generating proportional character spacing in the context of dot-matrix printing devices in which the print head advances by an amount corresponding to the width of the character, a special character generator is commonly used in which a combination is assigned to each individual character and contains information regarding the character width. In order to enable the printing mechanism to advance the varying lengths of travel which are necessary in this system, the character generator must be sampled by an involved process in order to obtain this information, with the information subsequently being supplied to control electronics. Such a character generator for proportional spacing is thus considerably more complex in construction and circuit outlay than a character generator for generating characters with fixed spacing.

SUMMARY OF THE INVENTION

It is an object of the present invention to provide an apparatus for dot-matrix printing devices, such as, for example, mosaic ink printing devices, which enables proportional character spacing to be obtained with the use of a known simple character generator otherwise intended only for generating characters with a constant character spacing (fixed spacing).

The above object is inventively achieved in an apparatus which utilizes a character generator of the type known in the art for generating characters with fixed spacing in which a storage area of equal size is assigned to each character, regardless of the actual width of the character, and in which one advance increment corresponds to each single column of the storage area. A control unit is provided having an operating state for generating proportional character spacing as well as an operating state for generating characters with fixed spacing, and having an evaluating unit for use in the operating state for generating proportional character spacing which, depending upon the column allocation of the storage areas, executes advance increments for occupied columns and assigns a space advance of a predetermined width to the total of the empty columns between two adjacent characters.

By operation of the above apparatus, all characters of common type fonts are written contiguously, that is, no blank columns occurring in the basic pattern within a character. It is therefore possible to control the movement of the print head in the device directly via the column pattern, in which case a character generator equipped for printing characters with a constant spacing can be used.

DESCRIPTION OF THE PREFERRED EMBODIMENTS

Figure 1:
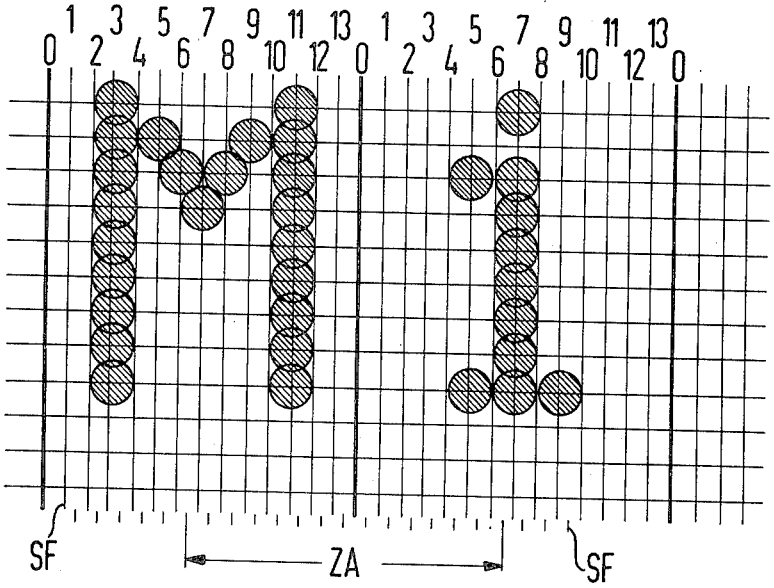
FIG. 1 is a graphic representation of characters printed using a dot-matrix printing device with fixed character spacing.

The characters "M" and "i" are shown in FIG. 1 as generated by a dot-matrix printing mechanism with a $9\times5$ and having corresponding half increments such that a constant character spacing ZA is present between the centers of adjacent characters. Such characters are generated by the use of a dot-matrix printing head which may be, for example, an ink printing head and which is driven by a character generator. The characters are stored in the character generator in matrix-like storage areas of equal size SF. The storage areas are comprised of fourteen columns, numbered from 0 to 13, and an appropriate number of rows. In the character field SF is a possible printing point for each matrix dot. When a character is called, these storage areas are scanned column by column, each column (0 to 13) of a storage area being assigned a single advance increment of the print head.

Proceeding from the premise that all characters of common known type fonts are written contiguously, that is, there is no blank column in the basic pattern of the character, the apparatus described below provides a means for driving a known character generator for generating characters with fixed character spacing ZA so as to enable generation of proportional character spacing. The blank columns such as 4 and 10 shown in FIG. 1 do not represent a blank column in the real sense, but rather represent a half increment.

Characters or symbols which are not written contiguously, such as quotation marks, are an exception to those types of characters which may be written by the apparatus described below with proportional character spacing. Such characters are assigned to a set of characters also containing numeric characters which must be written with fixed spacing.

Figure 2:
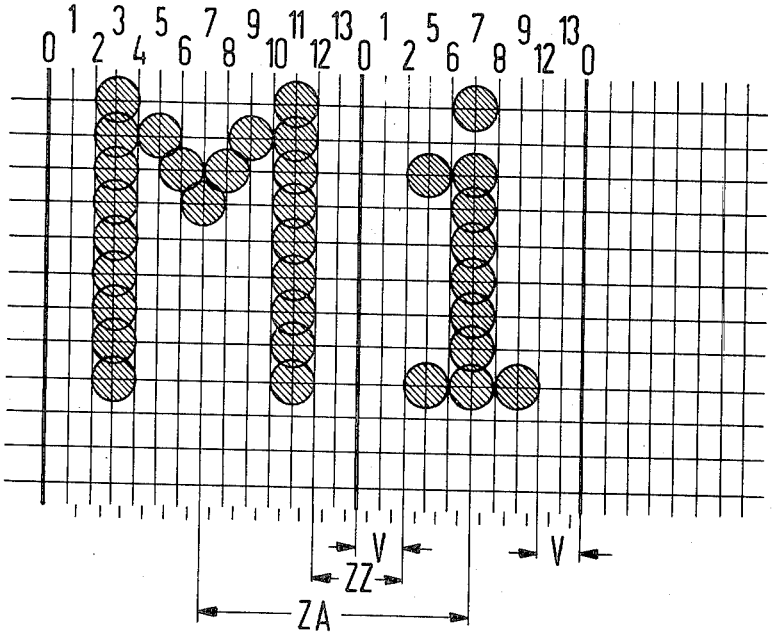
FIG. 2 is a graphic representation of characters printed using a dot-matrix printing device with proportional character spacing.

The underlying principal of the present invention is shown in FIG. 2 which is to allocate an advance increment to each column of the character matrix occupied by a print bit and to provide an advance increment with a defined width such as, for example, four single increments ZZ between two adjacent characters.

For printing the letter "i", for example, as shown in FIG. 2 the print carriage initially executes an advance V of a defined width which may, for example, be two columns, at the start of the character field (column 0). The blank columns 2 to 5 in between do not generate an advance and a further advance does not take place until the first occupied column 5. These single advances for generating the character "i" end at column 9. The subsequent blank columns between column 9 and column 12 are again skipped so that printing is suppressed. A further advance V then follows of the same width as the first advance V. The result of this selection principle is that the character spacing ZZ between two adjacent characters is always a constant defined width, while the character spacing ZA changes according to the characters to be written.

Because figures and various punctuation marks cannot be written with proportional spacing, owing to tabular output of such characters, it is appropriate to provide an automatic shift facility to insure fixed character spacing when such characters are called. This can be achieved simply by providing a coding device, which need not be described in greater detail herein, for accomplishing the shift.

Figure 3:
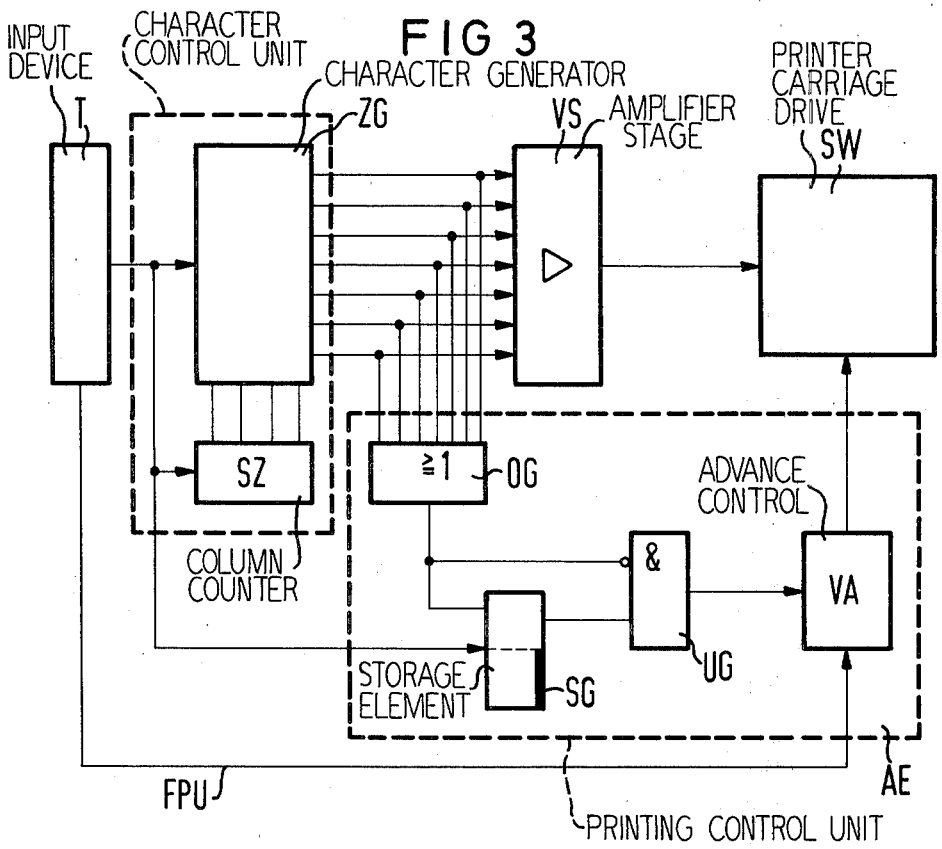
FIG. 3 is a schematic block diagram of an apparatus for a dot-matrix printing device for generating proportional character spacing.

In the circuit schematically represented in FIG. 3, a fixed constant character gap ZZ is achieved by the fact that advanced increments are executed only where columns are occupied, and the single advance increments are followed by an advance increment V of a defined width if an empty column is present after an occupied column.

As shown in FIG. 3, the information to be printed is fed in binary coded form to a character control unit by an appropriate input device T which may be, for example, a keyboard, magnetic tape, paper tape device or an external information supply line. The inputs are supplied to a character generator ZG in the character control unit. The control bits for the dot-matrix printing mechanism, having a printer carriage drive SW, are formed in the character control unit and are fed to the drive SW via an amplifier stage VS. The character information is read out of the character generator ZG column by column by means of a column counter SZ, which is also connected to the input device T.

An OR circuit OG connected to each output line from the character generator ZG supplies an output signal if the column is occupied by an information bit (print bit). This information is stored in a storage element SG which may, for example, be a one-shot multivibrator.

A post-connected AND gate UG provides a trigger signal to an advance-initiating control unit VA, which signal initiates a large advance ZZ in the carriage drive SW if the column at that moment present at the OR gate OG does not contain an information bit but the preceding column did contain an information bit. In this case a logic 0 is present at the inverting input of the AND gate UG and a logic 1 is present at the non-inverting input. The AND gate UG therefore supplies a signal for initiating the advance ZZ. The control unit VA controlling the carriage may be inhibited via a line FPU received from the input device T if the characters are to be written with constant spacing, such as numbers, quotation marks and the like. The inhibiting may take place automatically if a decoding device is provided which is triggered by the input of numbers or quotation marks.

The advance control VA, the storage element SG, and the logic circuitry thus form a printing control unit AE which may be used with conventional character control units which are capable of generating fixed character spacing in order to achieve proportional character spacing when desired.

Although modifications and changes may be suggested by those skilled in the art it is the intention of the inventor to embody within the patent warranted hereon all changes and modifications as reasonably and properly come within the scope of his contribution to the art.

I claim as my invention:

1. An apparatus for dot-matrix printing of characters for use with an input device and an incrementally advanceable printer carriage comprising:

a character generator in which said characters are stored in binary bit form in respective matrices of columns and rows, said matrices being of equal size regardless of the actual width of characters stored therein such that a plurality of columns in a number of said matrices are unoccupied by character bits, one incremental advance of said printer carriage normally corresponding to one column in the storage matrix of a character to be printed;

a character control unit connected to said input device and to said character generator, said character control unit operable in a fixed character spacing state and a proportional character spacing state depending upon the type of character to be printed as received from said input device; and a printer control unit connected to said character control unit for controlling the incremental advancement of said printer carriage, said printer control unit operable, when said character control unit is in said proportional character spacing state, for initially advancing said printer carriage by a first fixed number of increments, inhibiting advancement of said printer carriage until an occupied column in said storage matrix, advancing said printer carriage in single-column increments for columns in the storage matrix of a character to be printed which are occupied by a character bit, and for advancing said printer carriage a second fixed number of increments for the total number of unoccupied columns remaining in the respective storage matrix for a character.

2. The apparatus of claim 1 wherein said printer control unit comprises:

a storage element connected to said character control unit for storing information as to whether each column in the storage matrix of a character to be printed is occupied or unoccupied by a binary bit; and logic circuitry connected to said storage element and to said character generator for triggering said preselected constant advancement of said printer carriage whenever a column in a storage matrix containing a binary bit is followed by a column having no binary bit.

3. The apparatus of claim 2 wherein said logic circuitry is comprised of:

a multiple-input OR gate having an input from said character generator corresponding to each column in said storage matrices, and having an output connected to said storage element; and an AND gate having an inverting input connected to the output of said OR gate and having a non-inverting input connected to an output of said storage element, said AND gate having an output connected to said printer carriage for incrementally advancing said carriage.

4. The apparatus of claim 2 wherein said storage element is a one-shot multivibrator.

* * * * *